US006074225A

United States Patent [19]

Wu et al.

[11] Patent Number: 6,074,225

[45] Date of Patent: Jun. 13, 2000

[54] ELECTRICAL CONNECTOR FOR INPUT/OUTPUT PORT CONNECTIONS

[75] Inventors: Kun-Tsan Wu, Tu-Chen; Jen-Jou Chang, Yung-Ho; Chin-Yi Lai, Tu-Chen, all of Taiwan

[73] Assignee: Hon Hai Precision Ind. Co., Ltd., Taipei Hsien, Taiwan

[21] Appl. No.: 09/290,771

[22] Filed: Apr. 13, 1999

[51] Int. Cl.[7] ..... H01R 4/66

[52] U.S. Cl. ..... 439/101; 439/92; 439/939

[58] Field of Search ..... 439/92, 101, 108, 439/607, 608, 609, 610, 680, 939

[56] References Cited

U.S. PATENT DOCUMENTS

| | | | |
|---|---|---|---|
| 4,265,506 | 5/1981 | Hollyday | 439/609 |
| 5,125,853 | 6/1992 | Hashiguchi | 439/607 |
| 5,256,074 | 10/1993 | Tan et al. | 439/108 |
| 5,259,772 | 11/1993 | Fusselman et al. | 439/108 |
| 5,266,053 | 11/1993 | Jamet et al. | 439/607 |
| 5,474,472 | 12/1995 | Niwa et al. | 439/608 |
| 5,755,592 | 5/1998 | Hillbish et al. | 439/939 |

*Primary Examiner*—Paula Bradley
*Assistant Examiner*—Katrina Davis
*Attorney, Agent, or Firm*—Wei Te Chung

[57] ABSTRACT

An electrical connector includes an insulative housing having a shielding shell made of a conductive material fitted thereto. The housing has two groups of pins separated by a central slot defined therebetween with a conductive plate received therein. The conductive plate is in electrical connection with the shielding shell. The conductive plate has two resilient fingers formed on a front edge thereof and thus engageable with a counterpart conductive plate of a mating connector. The resiliency of the fingers provides a positive engagement between the two conductive plates thereby establishing a sound electrical connection therebetween. This allows electrostatic charges on the conductive plates to be effectively removed through the shielding shell.

10 Claims, 8 Drawing Sheets

ELECTRICAL CONNECTOR FOR INPUT/OUTPUT PORT CONNECTIONS

BACKGROUND OF THE INVENTION

1. Field of the Invention

The present invention generally relates to an electrical connector, and particularly to a low profile electrical connector.

2. The Prior Art

Electrical connectors for input/output port connection are usually provided with a metal shielding shell fitting over and surrounding a mating projection of the connector in order to eliminate electromagnetic interference (EMI). The shielding shell is electrically connected to a circuit board on which the connector is mounted whereby electrostatic charges are discharged. Examples of such shielding shells are disclosed in U.S. Pat. Nos. 4,943,244, 5,066,237, 5,104,326, 5,125,853, 5,218,294, 5,304,069 and 5,591,050. However, the connectors disclosed in these patents have shielding shells positioned between two mating connectors which may not be properly engaged with each other whereby an electrical discontinuity exists when grounding the shielding shell. This adversely affects the protection against EMI provided by the shielding shells.

To overcome the problem of electrical discontinuity, the shielding shell is provided with raised or projecting portion (s) or resilient member(s) which allow a better physical engagement to be established between the shielding shells of two mating connectors. This is known from U.S. Pat. Nos. 4,938,704 and 5,567,169.

However, with the rapid development of computer and telecommunication technology, problems associated with electrostatic discharge (ESD) and cross talk arise. In a connector having multiple rows of pins, the cross talk problem is conventionally resolved by adding a conductive plate or a metal sheet between adjacent rows. When connecting two mating connectors, the conductive plates of the two connectors are brought into contact with each other thereby establishing an electrical engagement therebetween. This technique is taught by U.S. Pat. Nos. 4,824,377, 5,066,240 and 5,567,168. However, conventionally, the conductive plate is provided with a substantially straight mating edge. Thus, the mating edges of the conductive plates of the mating connectors may not be in positive contact engagement with each other due to manufacturing tolerances.

It has also been proposed to provide metal bars on the mating surface of a connector. The metal bars have such a length that allows the bars to contact the mating connector before contacting the pins of the connector. As shown in U.S. Pat. No. 4,179,178 and Taiwan Patent Application Nos. 86204553 and 86206415. This, although providing a better solution, requires a complicated structure of the connector thereby increasing manufacturing cost. Moreover, the connector is not protected from cross talk.

It is thus desirable to have an electrical connector which can overcome the problems of the prior art.

SUMMARY OF THE INVENTION

Accordingly, an object of the present invention is to provide an electrical connector comprising a grounding device which allows a positive electrical engagement to be established between two mating connectors.

Another object of the present invention is to provide an electrical connector comprising means for quickly and effectively discharging electrostatic charges accumulated thereon.

Another object of the present invention is to provide an electrical connector wherein a cross talk suppressing member is provided and electrically connected to a grounding shell thereby effectively suppressing cross talk.

A further object of the present invention is to provide an electrical connector wherein an electrical engagement thereof with a mating connector is provided by means of resilient members thereby ensuring a sound connection therebetween.

To achieve the above objects, an electrical connector in accordance with the present invention comprises an insulative housing having a shielding shell made of a conductive material fitted thereto. The housing has two groups of pins separated by a central slot defined therebetween with a conductive plate received therein. The conductive plate is in electrical connection with the shielding shell. The conductive plate has two resilient fingers formed on a front edge thereof and thus engageable with a counterpart conductive plate of a mating connector. The resiliency of the fingers provides a positive engagement between the two conductive plates thereby establishing a sound electrical connection therebetween. This allows electrostatic charges on the conductive plates to be effectively removed through the shielding shell.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
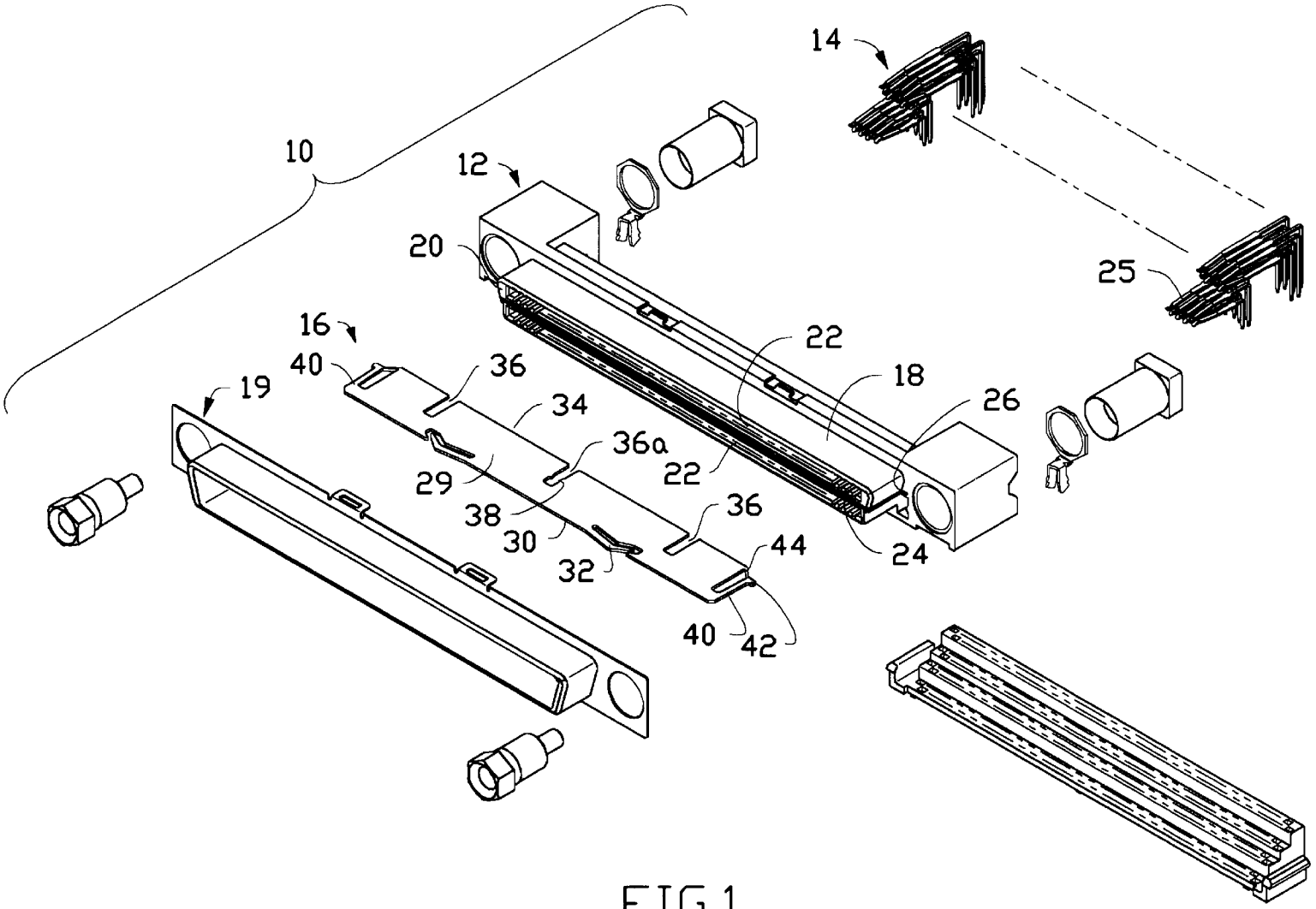
FIG. 1 is an exploded view of an electrical connector constructed in accordance with a first embodiment of the present invention.
Figure 2:
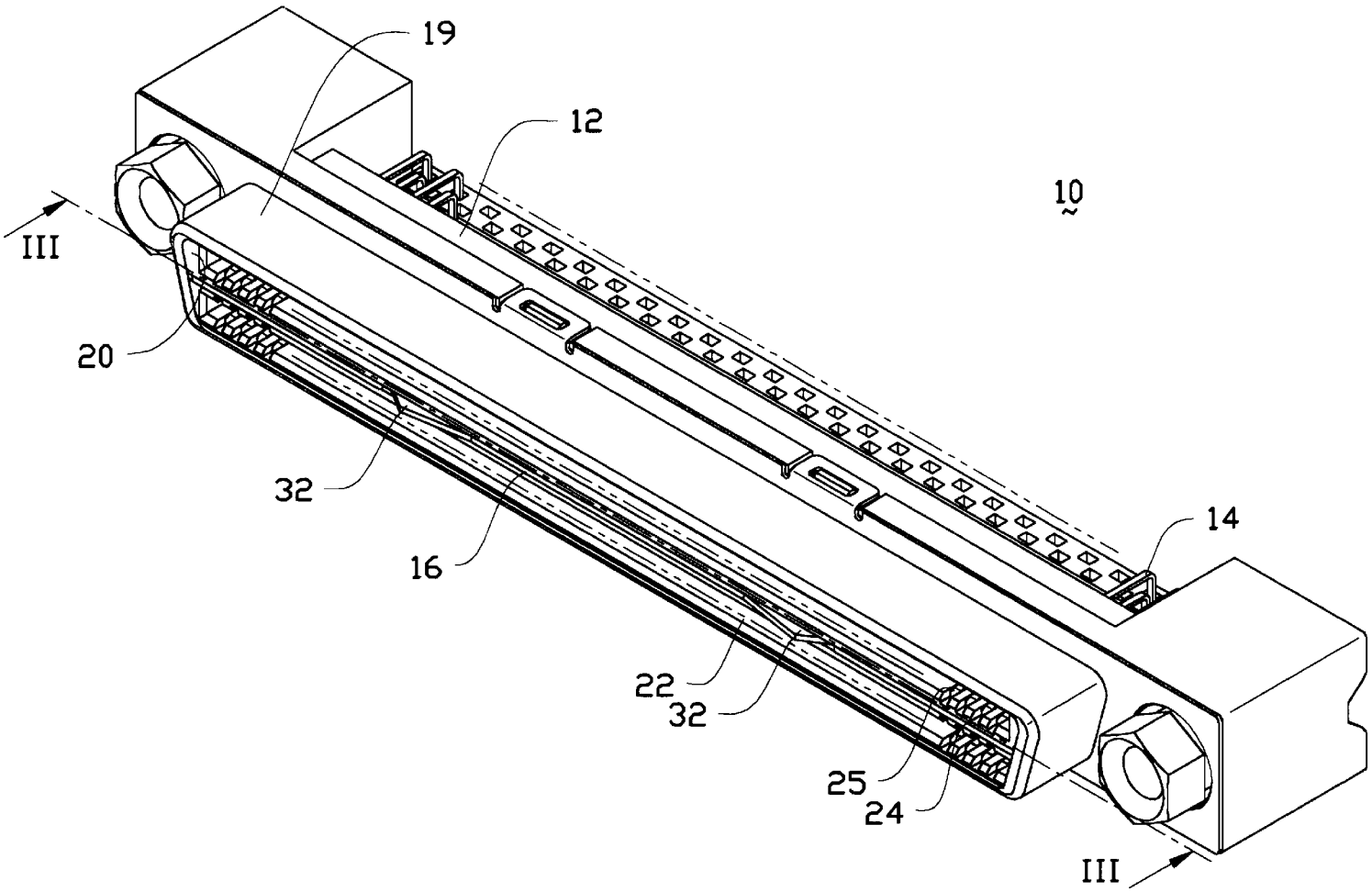
FIG. 2 is an assembled view of FIG. 1.

Referring to the drawings and in particular to FIGS. 1 and 2, wherein an electrical connector constructed in accordance with a first embodiment of the present invention, generally designated by reference numeral 10, is shown, the electrical connector 10 comprises an insulative housing 12 having a mating projection 18 extending from one side face thereof. A shielding shell 19 made of a conductive material, such as metal, is fit over the mating projection 18. The mating projection 18 has a free mating face 20 and defines two receptacle slots 22 therein. The mating projection 18 also defines a central slot 26 substantially co-extensive therewith.

The housing 12 defines a plurality of pin receiving channels 24 in communication with the receptacle slots 22. Each channel 24 receives and retains a conductive pin 14 with a free end 25 thereof being located inside the corresponding receptacle slot 22.

A conductive plate 16, such as a metal sheet, has an elongate body 29 received in the central slot 26 of the housing 12. The conductive plate 16 is dimensioned to have a front edge 30 thereof substantially flush with the free mating face 20 of the mating projection 18. However, it should be noted that if desired, the conductive plate 16 may be dimensioned whereby the front edge 30 extends beyond the free mating face 20 or is completely received inside the central slot 26.

Figure 3:
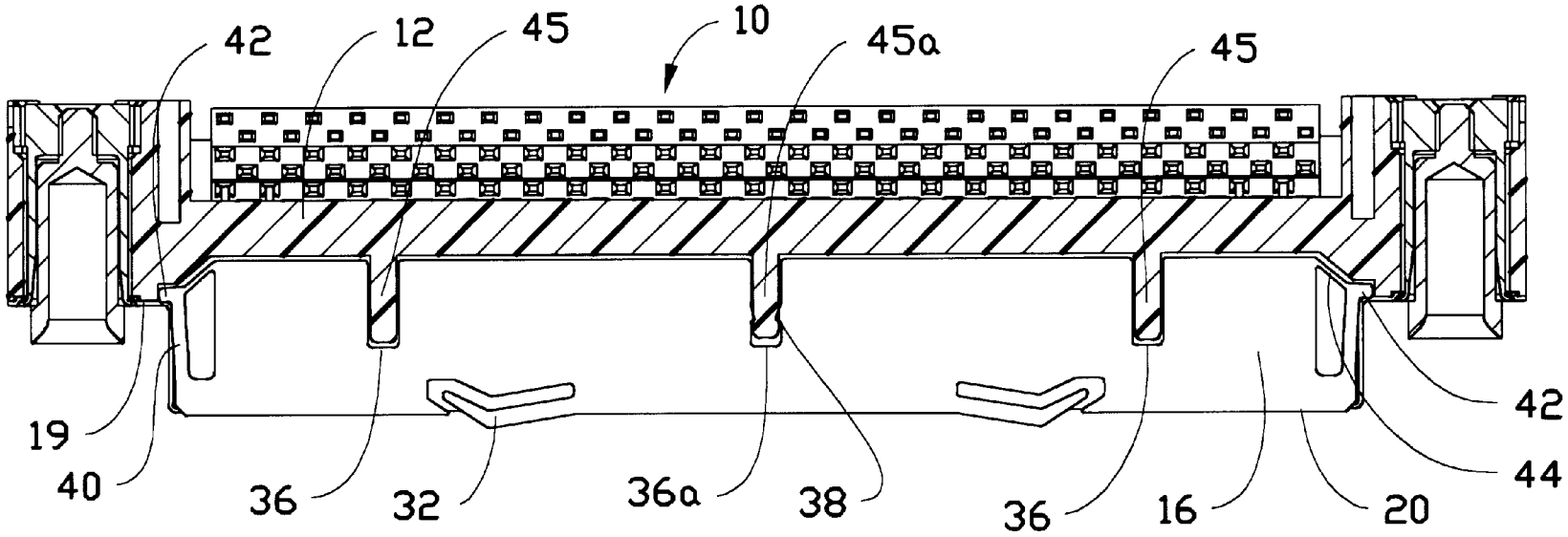
FIG. 3 is a cross-sectional view taken along line III—III of FIG. 2.
Figure 4:
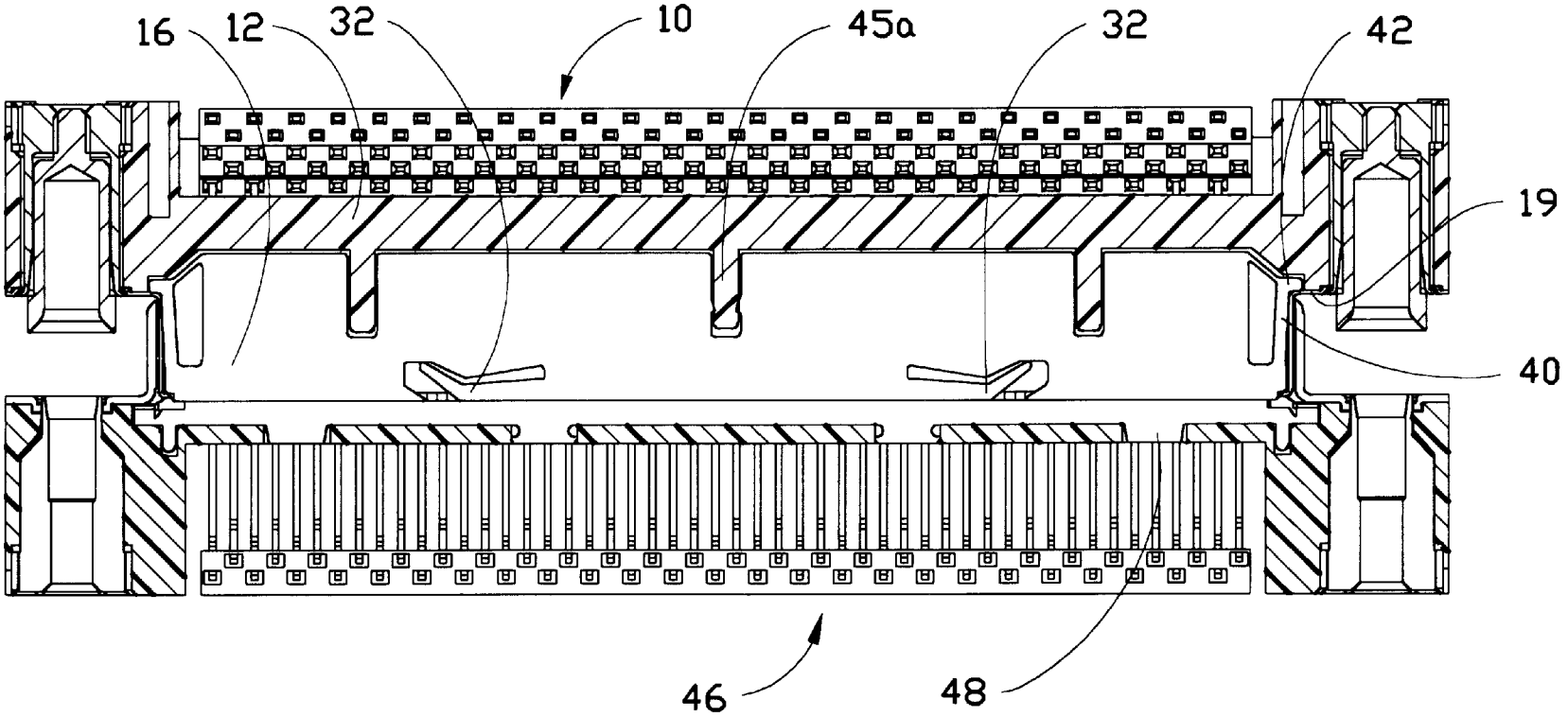
FIG. 4 shows cross-sectional view of FIG. 3 connected to a mating connector.

The front edge 30 of the conductive plate 16 has at least one resilient finger 32 projecting therefrom. The resilient fingers 32 are dimensioned to have at least a portion thereof extending beyond the free face 20 of the mating projection 18 of the housing 12, as shown in FIGS. 2 and 3. In the embodiment illustrated, the conductive plate 16 has two resilient fingers 32 extending from the body 29 of the conductive plate 16 in a cantilevered fashion with an arced or curved central portion thereof extending beyond the front edge 30. However, the resilient fingers 32 may have a different configuration which provides resiliency in a direction toward/away from the front edge 30. The resilient fingers 32 provide means for a firm physical contact with a counterpart conductive plate 48 of a mating connector 46 as shown in FIG. 4. This allows a positive electrical engagement to be established between the connectors 10, 48.

Referring back to FIGS. 1 and 3, the conductive plate 16 also has a rear edge 34 which defines a first cutout 36*a* for receiving a projection 45*a* extending from the housing 12 into the central slot 26 for retaining the conductive plate 16 in the central slot 26. The projection 45*a* is provided with notches (not labeled) engaging with barbs 38 formed on the conductive plate 16 and extending into the cutout 36*a* thereby securing the conductive plate 16 in the central slot 26.

If desired, the rear edge 34 of the conductive plate 16 may be provided with additional cutouts 36 for receiving corresponding projections 45 extending from the housing 12 into the central slot 26 for positioning purposes.

The conductive plate 16 has two longitudinal ends each forming a resilient arm 40. Each arm 40 has a sideways extension 42 and the central slot 26 is further defined with an extension slot (not labeled) for receiving the sideways extension 42 of the arm 40. The extension 42 of the arm 40 is positioned such that the extension 42 is overlapped and thus securely retained in the slot 26 by the shielding shell 19. The resiliency of the arm 40 provides a positive engagement between the extension 42 thereof and the shielding shell 19. Thus, a secure electrical connection is formed therebetween.

The resilient arm 40 may be connected to the body 29 of the conductive plate 16 by means of a reinforcement rib 44 extending from a free end of the arm 40 to the body 29. This reinforces the structure of arm 40 thereby protecting the arm 40 from being damaged during the manufacturing process of the conductive plate 16.

Figure 8:
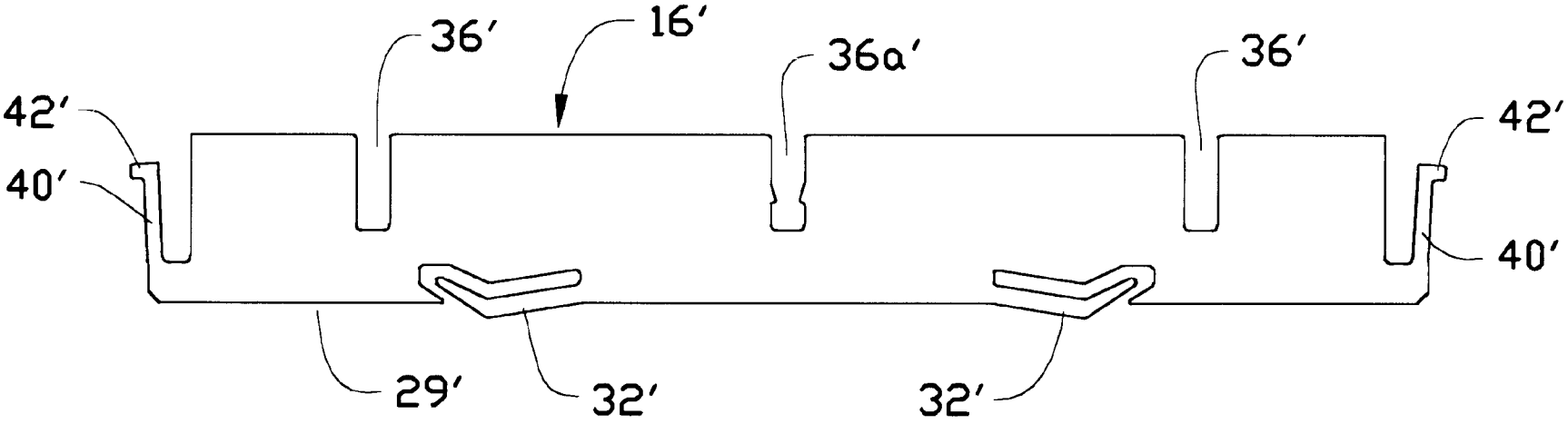
FIG. 8 is a plan view showing a conductive plate constructed in accordance with a further embodiment of the present invention to be incorporated in the connector of FIG. 1.

However, it should be noted that the reinforcement rib 44 may be removed, if desired. This is illustrated in another embodiment of the present invention shown in FIG. 8. In FIG. 8, a conductive plate, designated by reference numeral 16', is shown. The conductive plate 16' has a structure similar to that of the conductive plate 16 of the first embodiment. The conductive plate 16' comprises an elongate body 29' forming resilient fingers 32' on a front edge thereof, cutouts 36', 36*a*' on a rear edge thereof and a resilient arm 40' on each longitudinal end of the body 29'. Each of the arms 40' is constructed as a cantilevered arm having a free end on which a sideways extension 42' is formed.

The connector 10 of the first embodiment illustrated in FIGS. 1–4 is a receptacle-type connector. A counterpart plug-type connector in accordance with the present invention is illustrated in FIGS. 5–7 as a second embodiment.

Figure 5:
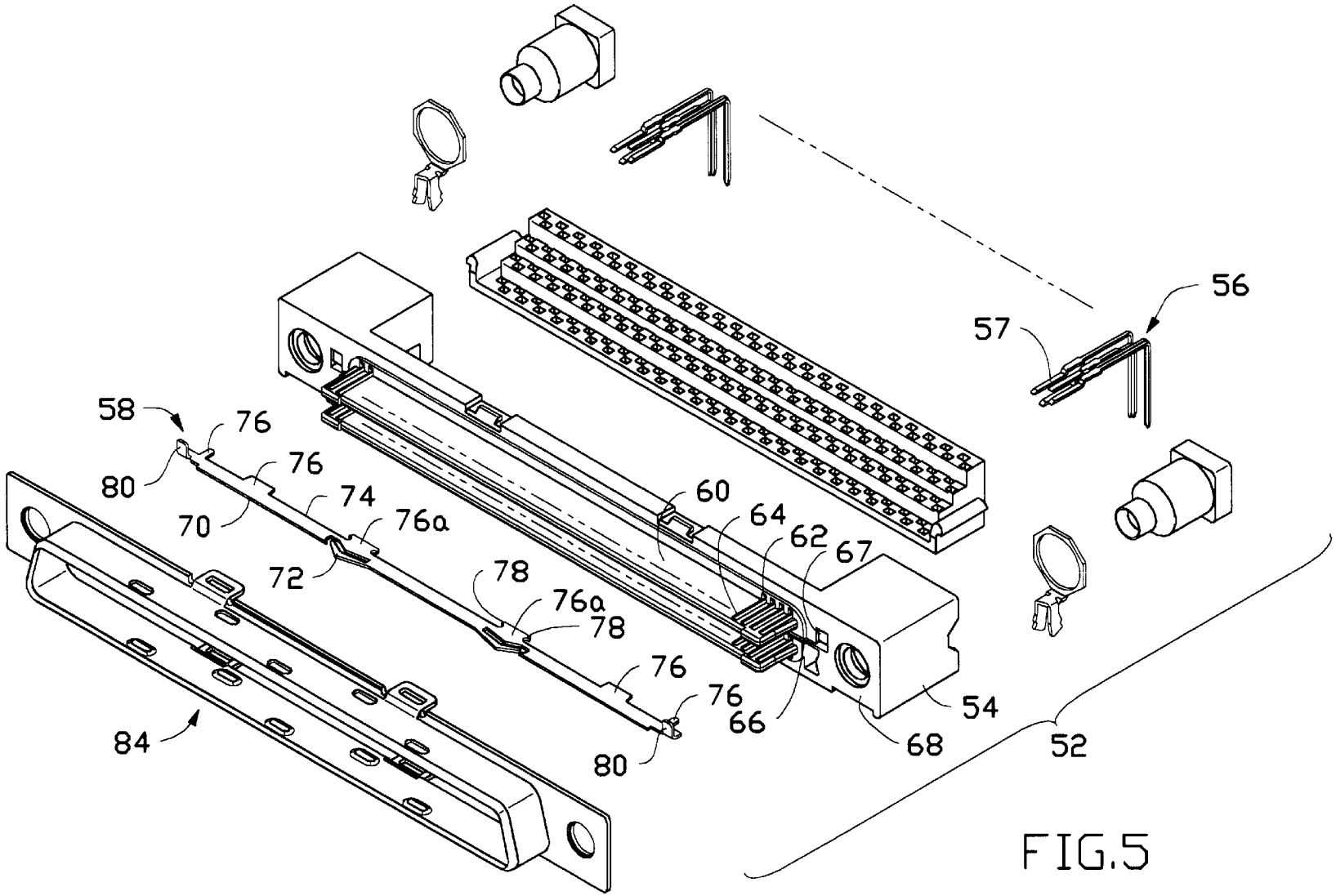
FIG. 5 is an exploded view of an electrical connector constructed in accordance with a second embodiment of the present invention.
Figure 6:
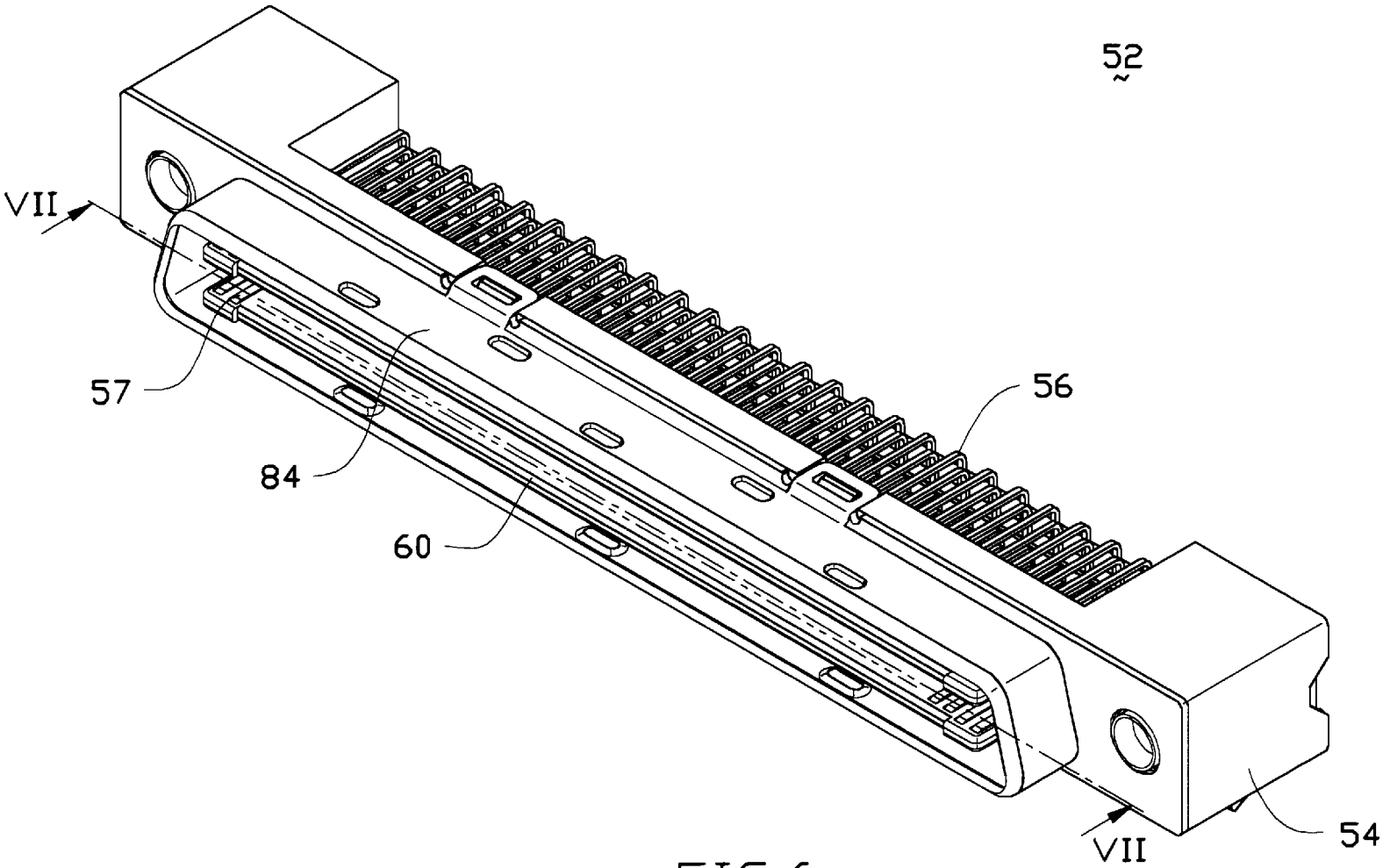
FIG. 6 is an assembled view of FIG. 5.
Figure 7:
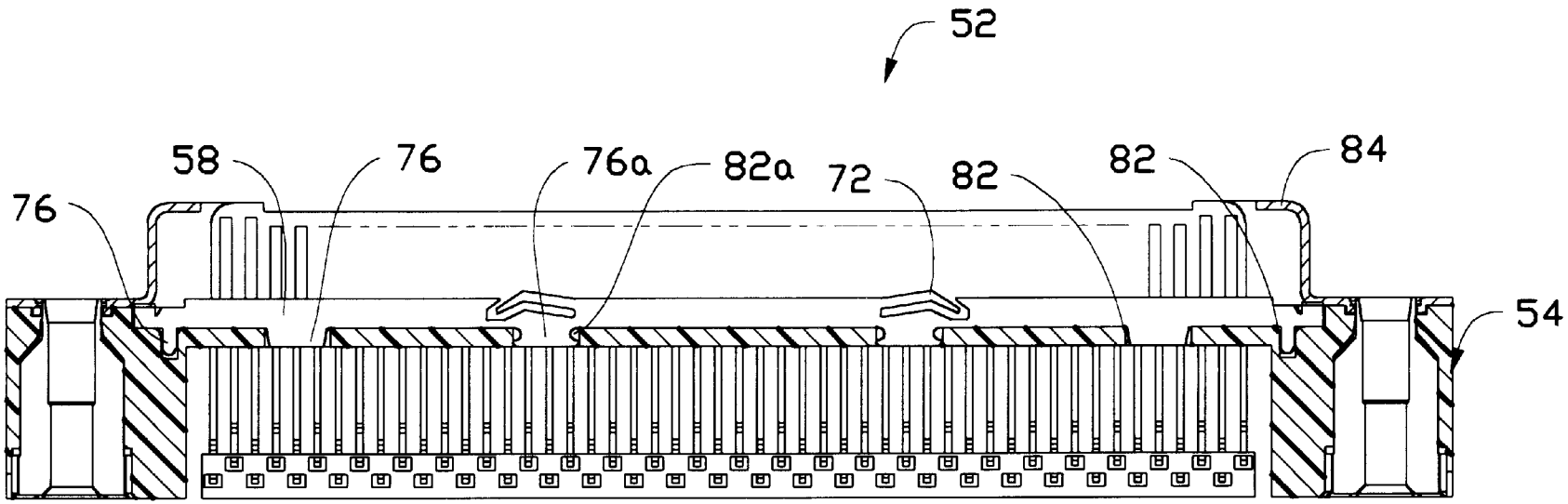
FIG. 7 is a cross-sectional view taken along line VII—VII of FIG. 6.

Referring to FIGS. 5–7, a plug-type connector in accordance with the present invention which is designated by reference numeral 52 comprises an insulative housing 54 defining a plurality of passages 62 receiving conductive pins 56 therein. Two tongue plates 60 extend from a mating face 68 of the housing 54. The tongue plates 60 have pin receiving channels 64 defined therein for receiving free ends 57 of the pins 56. The tongue plates 60 are receivable in and engageable with slots defined in a mating receptacle type connector.

A shielding shell 84 is attached to the mating face 68 of the housing 54 for surrounding the tongue plates 60.

The housing 54 defines a central slot 66 between the two tongue plates 60 and exposed to the mating face 68 thereof for receiving a conductive plate 58 therein. The conductive plate 58 has a front edge 70 on which at least one resilient finger 72 is provided. The resilient finger 72 extends beyond the front edge 70 of the conductive plate 58. In the embodiment illustrated, the conductive plate 58 has two resilient fingers 72 provided on the front edge 70 thereof. The conductive plate 58 is dimensioned to have the front edge 70 thereof substantially flush with the mating face 68 as shown in FIG. 7 whereby the resilient fingers 72 project beyond the mating face 68 of the housing 54.

The conductive plate 58 has a rear edge 74 which forms at least one positioning projection 76*a* for being received in a corresponding recess 82*a* (FIG. 7) defined in the housing 54 in communication with the slot 66. Preferably, the projection 76*a* forms barbs 78 on opposite sides thereof for engaging with side walls of the recess 82*a*. If desired, additional positioning projections 76 may be provided on the rear edge 74 of the conductive plate 58 for being received in additional recesses 82 defined in the housing 54.

The conductive plate 58 has two longitudinal ends each forming a retaining tab 80 for being received in a recessed section 67 defined in the mating face 68 of the housing 54. The retaining tab 80 is located at such a position with respect to the housing 54 whereby the retaining tab 80 is overlapped and thus fixed in the recessed section 67 by the shielding shell 84 as shown in FIG. 7. This secures the conductive plate 58 in the slot 66 of the housing 54 and provides a secure electrical connection between the conductive plate 58 and the shielding shell 84.

Although the present invention has been described with reference to the preferred embodiments thereof, it is apparent to those skilled in the art that there are a variety of modifications and changes that may be made without departing from the scope of the present invention which is intended to be defined by the appended claims.

What is claimed is:

1. An electrical connector adapted to mate with a second mating connector, the electrical connector comprising:

an insulative housing having a mating face through which at least two groups of pin receiving channels are defined, the at least two groups of pin receiving channels, being separated by a slot defined in the housing, each of the two groups of pin receiving channels receiving a conductive pin therein;

a conductive plate received in the slot, the conductive plate having a front edge on which at least one resilient finger is formed and partially extending beyond the mating face for engaging with a counterpart conductive plate of the second mating connector whereby by means of resiliency, the at least one resilient finger is deformed when contacting the counterpart conductive plate thereby providing a positive electrical engagement therebetween; and providing means for electrically grounding the conductive plate, the means for electrically grounding the conductive plate comprises a shielding shell made of a conductive material fixed to the mating face and in electrical connection with the conductive plate;

a mating projection extending from the housing and having a free surface defining the mating face, the mating projection defining two receptacle slots therein, each receptacle slot having the at least two groups of contact pins arranged therein thereby defining the two receptacle slots, the slot for receiving the conductive plate being located between the two receptacle slots, the shielding shell being configured to fit over the mating projection of the housing; the housing comprises two tongue plates extending from the mating face, each of the tongue plates having free ends of contact pins mounted thereon, the slot for receiving the conductive plate being located between the two tongue plates, the shielding shell being fixed to the mating face of the housing and surrounding the two tongue plates, the slot for receiving the conductive plate is further defined with at least one end extension slot located below a portion of the shielding shell and the conductive plate forms an extension received in the end extension slot thereby being overlapped and thus in electrical connection with the shielding shell, the extension of the conductive plate is connected to the conductive plate by means of a resilient member which provides a positive contact engagement of the extension with the shielding shell, the resilient member comprises a cantilevered arm having a free end on which the extension is formed, the free end of the of the cantilevered arm is fixed to the conductive plate by means of a reinforcement rib, the housing comprises means for retaining the conductive plate in the slot, the means for retaining the conductive plate in the slot comprises at least one projection formed on the housing and extending into the slot and a cutout defined in the conductive plate for receiving the projection therein.

2. The electrical connector as claimed in claim 1, wherein the cutout is further defined with notches and wherein the projection inside the slot forms barbs engageable with the notches of the cutout.

3. The electrical connector as claimed in claim 2, wherein the means for holding the conductive plate in the slot comprises a second projection formed on the housing extending into the slot and a corresponding second cutout defined in the conductive plate for engaging with the second projection.

4. The electrical connector as claimed in claim 1, wherein the means for retaining the conductive plate in the slot comprises at least one projection formed on the conductive plate, the slot for receiving the conductive plate being further defined with a recess corresponding to and receiving the projection therein.

5. The electrical connector as claimed in claim 4, wherein the projection of the conductive plate comprises barbs on opposite sides thereof for engaging with side walls of the recess.

6. The electrical connector as claimed in claim 5, wherein the means for retaining the conductive plate in the slot comprises a second projection formed on the conductive plate, the slot being further defined with a corresponding second recess for receiving the second projection.

7. An electrical connector comprising an insulative housing having at least two groups of conductive pins arranged therein, the housing defining a slot therein separating the two groups of conductive pins, a conductive plate being received in the slot, the conductive plate having at least one extension connected thereto by means of a resilient member, a conductive shielding shell being fixed to the housing to enclose the two groups of conductive pins, the shielding shell having a portion overlapping the extension of the conductive plate and the resilient member thereby providing a secure contact engagement therebetween, the resilient member comprises a cantilevered arm having a free end on which the extension is formed and the free end of the cantilevered arm is fixed to the conductive plate by means of a reinforcement rib, the conductive plate comprises at least one resilient finger formed thereon, the resilient finger partially extending beyond a face of the housing and adapted to be in contact engagement with a counterpart conductive plate of a mating connector.

8. An electrical connector adapted to mate with a second mating connector, the electrical connector comprising:

an insulative housing having a mating face through which at least two groups of pin receiving channels are defined, the two groups of pin receiving channels being separated by a slot defined in the housing, each of the two groups of pin receiving channels receiving a conductive pin therein;

a conductive plate received in the slot, the conductive plate having a front edge on which at least one resilient finger is formed and partially extending beyond the mating face for engaging with a counterpart conductive plate of a second mating connector whereby by means of the resiliency, the at least one resilient finger is deformed when contacting the counterpart conductive plate thereby providing a positive electrical engagement therebetween;

a shielding shell which is electrically grounded, the shielding shell being attached to the mating face for enclosing and shielding the pins; and means for electrically grounding the conductive plate, the housing comprises a mating projection extending therefrom and having a free surface defining the mating face, the mating projection defining two receptacle slots therein, each receptacle slot having the pin receiving channels arranged therein thereby defining the two receptacle slots, the slot for receiving the conductive plate being located between the two receptacle slots, the shielding shell being configured to fit over the mating projection, the housing comprises two tongue plates extending from the mating face, each of the tongue plates having free ends of contact pins mounted therein thereby defining the two tongue plates, the slot for receiving the conductive plate being located between the two tongue plates, the shielding shell being fixed to the mating face of the housing and surrounding the two tongue plates, the slot for receiving the conductive plate is further defined with at least one end extension slot located below a portion of the shielding shell and 3, wherein the means for electrically grounding the conductive plate comprises an extension from the conductive plate received in the at least one end extension slot for being overlapped by and thus in electrical connection with the shielding shell, the extension of the conductive plate is connected to the conductive plate by means of a resilient member which provides a positive contact engagement of the extension with the shielding shell, the resilient finger comprises a cantilevered beam-like member extending from the front edge of the conductive plate, the cantilevered beam-like member having a convex curved central portion projecting out of the mating face of the housing.

9. The electrical connector as claimed in claim 8, wherein the resilient member comprises a cantilevered arm having a free end on which the extension is formed.

10. The electrical connector as claimed in claim 9, wherein the free end of the cantilevered arm is fixed to the conductive plate by means of a reinforcement rib.

* * * * *